US011315451B1

(12) United States Patent
Fu

(10) Patent No.: US 11,315,451 B1
(45) Date of Patent: Apr. 26, 2022

(54) DISPLAY DEVICE AND ELECTRONIC DEVICE

(71) Applicant: TCL CHINA STAR OPTOELECTRONICS TECHNOLOGY CO., LTD., Shenzhen (CN)

(72) Inventor: Xiaoli Fu, Shenzhen (CN)

( * ) Notice: Subject to any disclaimer, the term of this patent is extended or adjusted under 35 U.S.C. 154(b) by 247 days.

(21) Appl. No.: 16/761,248

(22) PCT Filed: Apr. 3, 2020

(86) PCT No.: PCT/CN2020/083151

§ 371 (c)(1),
(2) Date: May 3, 2020

(87) PCT Pub. No.: WO2021/174628

PCT Pub. Date: May 3, 2020

(30) Foreign Application Priority Data

Mar. 4, 2020 (CN) ..... 202010143461.X

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2310/0275* (2013.01); *G09G 2310/08* (2013.01); *G09G 2330/12* (2013.01)

(58) Field of Classification Search
None
See application file for complete search history.

(56) References Cited

U.S. PATENT DOCUMENTS

| | | | | |
|---|---|---|---|---|
| 2007/0121263 | A1 | 5/2007 | Liu | |
| 2008/0192035 | A1 | 8/2008 | Guan | |
| 2015/0339959 | A1 | 11/2015 | Li et al. | |
| 2018/0113333 | A1* | 4/2018 | Zhu | G09G 3/3611 |
| 2021/0364870 | A1* | 11/2021 | Chen | G02F 1/136286 |

FOREIGN PATENT DOCUMENTS

| | | | |
|---|---|---|---|
| CN | 1632850 | A | 6/2005 |
| CN | 101097673 | A | 1/2008 |
| CN | 102402089 | A | 4/2012 |
| CN | 104021747 | A | 9/2014 |
| CN | 104730341 | A | 6/2015 |
| CN | 105607320 | A | 5/2016 |
| CN | 107068092 | A | 8/2017 |
| CN | 109119043 | A | 1/2019 |
| CN | 109389946 | A | 2/2019 |
| CN | 110718177 | A | 1/2020 |
| CN | 209993326 | U | 1/2020 |

* cited by examiner

*Primary Examiner* — Christopher J Kohlman

(57) ABSTRACT

A display device and an electronic device are provided. The display device is provided with a control unit between a driving chip and an electrostatic test point. During an electrostatic test, the control unit is disconnected from the driving chip to form a protection circuit for the driving chip under control of a first control signal and a second control signal, which can effectively prevent the driving chip from damage by static electricity.

18 Claims, 2 Drawing Sheets

DISPLAY DEVICE AND ELECTRONIC DEVICE

FIELD OF INVENTION

The present application relates to the field of display technologies, in particular to a display device and electronic device.

BACKGROUND OF INVENTION

Electrostatic discharge (ESD) refers to charge transfer caused by objects with different electrostatic potentials being close to or in direct contact with each other. Electrostatic discharge will generate an instantaneous voltage of thousands of volts, causing electrostatic damage, making display devices unable to work properly. In order to prevent electrostatic damage, an ESD test is required in a production process of the display devices. For example, static electricity is directly input from a test point set between a substrate and a driving chip, and the ESD test is performed on the driving chip that is disposed on a chip on film (COF). However, because it is impossible to add transient voltage suppressor (TVS) tubes or varistors on traces for electrostatic protection, anti-static capability of the driving chip is weak, and the driving chip is easily damaged during the test, thereby resulting in ESD test failure.

Technical Problem

In the display devices, because it is impossible to add transient voltage suppressor (TVS) tubes or varistors on traces for electrostatic protection, anti-static capability of the driving chip is weak, and the driving chip is easily damaged during the test, thereby resulting in ESD test failure.

SUMMARY OF INVENTION

Technical Solution

Embodiments of the present application provide a display device and an electronic device to solve a technical problem that a driving chip is easily damaged during electrostatic test.

The present application provides a display device, including:

a substrate;

a timing controller including a first signal output terminal and a second signal output terminal, the first signal output terminal configured to output a first control signal, and the second signal output terminal configured to output a second control signal; and a chip carrier film provided with a driving chip and a control unit, wherein the driving chip is configured to output a display signal to the substrate, the control unit includes an input terminal, an output terminal, a first control terminal, and a second control terminal, the input terminal is connected to the driving chip, the output terminal is connected to the substrate, the first control terminal is connected to the first signal output terminal, and the second control terminal is connected to the second signal output terminal;

wherein an electrostatic test point is further provided between the output terminal of the control unit and the substrate, the control unit is configured to output the display signal to the substrate under control of the first control signal and the second control signal, and configured to conduct an electrostatic test through the electrostatic test point.

In the display device provided by the present application, the control unit includes a first transistor and a second transistor, wherein:

a source of the first transistor is connected to the output terminal of the control unit, a gate of the first transistor is connected to the first control terminal, and a drain of the first transistor is grounded; and a source of the second transistor is connected to the source of the first transistor, a gate of the second transistor is connected to the second control terminal, and a drain of the second transistor is connected to the input terminal of the control unit.

In the display device provided by the present application, the first transistor and the second transistor are thin film transistors of a same type.

In the display device provided by the present application, when the first transistor is turned on and the second transistor is turned off, the electrostatic test is performed through the electrostatic test point, and when the first transistor is turned off and the second transistor is turned on, the control unit outputs the display signal to the substrate.

In the display device provided by the present application, the driving chip includes a plurality of signal output terminals, and the control unit is provided between at least one of the signal output terminals and the substrate.

In the display device provided by the present application, the display device according to claim 1, further including a circuit board, wherein an end of the chip carrier film is connected to the substrate, and another end of the chip carrier film is secured to the circuit board, and the timing controller is disposed on the circuit board.

In the display device provided by the present application, the driving chip is a source driving chip, and the source driving chip is configured to output a data signal to the substrate.

In the display device provided by the present application, the driving chip is a gate driving chip, and the gate driving chip is configured to output a scanning signal to the substrate.

In the display device provided by the present application, when the control unit outputs the display signal to the substrate under the control of the first control signal and the second control signal, a panel bonding impedance test is performed through the electrostatic test point.

Correspondingly, the present application provides an electronic device, including a display device, the display device including:

a substrate;

a timing controller including a first signal output terminal and a second signal output terminal, the first signal output terminal configured to output a first control signal, and the second signal output terminal configured to output a second control signal; and a chip carrier film provided with a driving chip and a control unit, wherein the driving chip is configured to output a display signal to the substrate, the control unit includes an input terminal, an output terminal, a first control terminal, and a second control terminal, the input terminal is connected to the driving chip, the output terminal is connected to the substrate, the first control terminal is connected to the first signal output terminal, and the second control terminal is connected to the second signal output terminal;

wherein an electrostatic test point is further provided between the output terminal of the control unit and the substrate, the control unit is configured to output the display signal to the substrate under control of the first control signal and the second control signal, and conducting an electrostatic test through the electrostatic test point.

In the electronic device provided by the present application, the control unit includes a first transistor and a second transistor, wherein:

a source of the first transistor is connected to the output terminal of the control unit, a gate of the first transistor is connected to the first control terminal, and a drain of the first transistor is grounded; and a source of the second transistor is connected to the source of the first transistor, a gate of the second transistor is connected to the second control terminal, and a drain of the second transistor is connected to the input terminal of the control unit.

In the electronic device provided by the present application, the first transistor and the second transistor are thin film transistors of a same type.

In the electronic device provided by the present application, when the first transistor is turned on and the second transistor is turned off, the electrostatic test is performed through the electrostatic test point, and when the first transistor is turned off and the second transistor is turned on, the control unit outputs the display signal to the substrate.

In the electronic device provided by the present application, the driving chip includes a plurality of signal output terminals, and the control unit is provided between at least one of the signal output terminals and the substrate.

In the electronic device provided by the present application, the electronic device further including a circuit board, wherein an end of the chip carrier film is connected to the substrate, and another end of the chip carrier film is secured to the circuit board, and the timing controller is disposed on the circuit board.

In the electronic device provided by the present application, the driving chip is a source driving chip, and the source driving chip is configured to output a data signal to the substrate.

In the electronic device provided by the present application, the driving chip is a gate driving chip, and the gate driving chip is configured to output a scanning signal to the substrate.

In the electronic device provided by the present application, when the control unit outputs the display signal to the substrate under the control of the first control signal and the second control signal, a panel bonding impedance test is performed through the electrostatic test point.

Beneficial Effect

The present application provides a display device and an electronic device. The display device is provided with a control unit between a driving chip and an electrostatic test point. During an electrostatic test, the control unit is disconnected from the driving chip to form a protection circuit for the driving chip under control of a first control signal and a second control signal, which can effectively prevent the driving chip from damage by static electricity.

BRIEF DESCRIPTION OF FIGURES

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION OF EMBODIMENTS

The following content combines with the drawings and the embodiment for describing the present application in detail. It is obvious that the following embodiments are merely some embodiments of the present application, but not all the embodiments. Based on the embodiments in the present application, for the skilled persons of ordinary skill in the art without creative effort, the other embodiments obtained thereby are still covered by the present application.

It should be noted that, in the description of this application, the terms "first", "second", and "third" are used for descriptive purposes only, and cannot be understood as indicating or implying relative importance or implicitly indicating the number of technical features indicated. Thus, the features defined as "first," "second," and "third" may explicitly or implicitly include one or more of the features, and are therefore not to be construed as limiting the invention.

Figure 1:
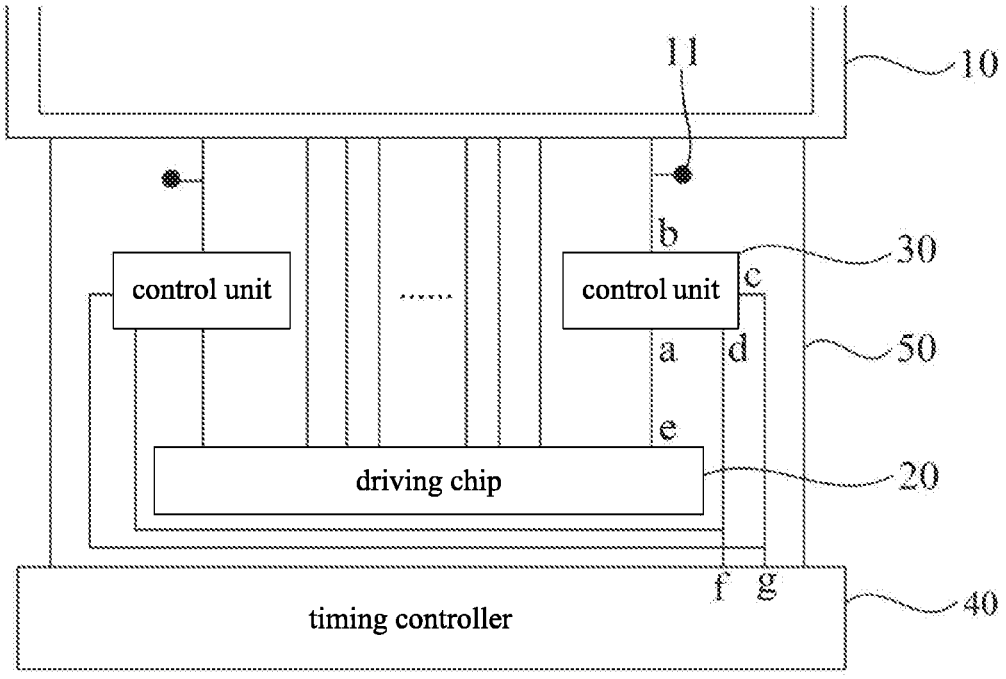
FIG. 1 is a first schematic structural diagram of a display device according to an embodiment of the present application.

Please refer to FIG. 1, an embodiment of the present application provides a display device. The display device includes a substrate 10, a timing controller 40 having a first signal output terminal f, and a second signal output terminal g, wherein the first signal output terminal f is configured to output a first control signal, and the second signal output terminal g is configured to output the second control signal; and a chip carrier film 50, wherein the chip carrier film 50 is provided with a driving chip 20 and a control unit 30, the driving chip 20 is configured to output a display signal to the substrate 10, the control unit 30 includes an input terminal a, an output terminal b, a first control terminal c, and a second control terminal d, the input terminal a is connected to the driving chip 20, the output terminal b is connected to the substrate 10, the first control terminal c is connected to the first signal output terminal f, and the second control terminal d is connected to the second signal output terminal g.

An electrostatic test point 11 is further provided between the output terminal b of the control unit and the substrate 10, the control unit 40 is configured to output the display signal to the substrate 10 under control of the first control signal and the second control signal, and is configured to conduct an electrostatic test through the electrostatic test point 11.

It should be noted that the driving chip 20 has a plurality of signal output terminals e. The control unit 30 is provided between at least one signal output terminal e and the substrate 10. In the embodiment of the present application, the control unit 30 is provided between the two signal output terminals e on both sides of the driving chip 20 and the substrate 10, respectively. Since the driving chip 20 has the signal output terminals e, a gap between adjacent signal output terminals e is small, the control unit 30 provided between the signal output terminals e on both sides of the driving chip 20 and the substrate 10 can ensure a sufficient space to dispose the control unit 30, and interference between the control unit 30 and the adjacent signal output terminal can be effectively prevented. It should be noted that, in some embodiments, the control unit 30 can also be provided between two of the signal output terminals e on both sides of the driving chip 20 and the substrate 10 to improve accuracy of the electrostatic test.

The driving chip 20 includes a source driving chip and/or a gate driving chip. The source driving chip is configured to output a data signal to the substrate 10. The gate driving chip is configured to output a scanning signal to the substrate 10. A plurality of vertical data lines arranged parallel to each other and a plurality of horizontal scanning lines arranged parallel to each other (not shown in figure) are provided in the substrate 10. When the driving chip 20 is the source driving chip, the output terminal b and the data lines on the substrate 10 are electrically connected. When the driving chip 20 is the gate driving chip, the output terminal b and the gate lines on the substrate 10 are electrically connected. The corresponding driving chip 20 can be set according to actual application, which is not limited in the present application.

The timing controller 40 outputs the first control signal through the first signal output terminal f, and outputs the second control signal to the control unit 30 through the second signal output terminal g. The first control signal and the second control signal can be high-level signals or low-level signals, which can be selected according to an internal circuit structure of the control unit 30 actually set, which is not limited in the present application.

When the display device displays normally, the timing controller 40 outputs the first control signal and the second control signal to the control unit 30 to realize a connection between the control unit 30 and the driving chip 20. The driving chip 20 normally outputs the data signal or the scanning signal to the substrate 10.

During the electrostatic test, when static electricity is injected beyond a tolerable range of the driving chip 20, the timing controller 40 outputs the first control signal and the second control signal to the control unit 30, disconnecting the connection between the control unit 30 and the driving chip 20. Meanwhile, static electricity is injected from the static electricity test point 11 to perform the electrostatic test. It should be noted that when static electricity is charged within the tolerable range of the driving chip 20, the timing controller 40 can also output the first control signal and the second control signal to the control unit 30 to maintain the connection between the control unit 30 and the driving chip 20. Meanwhile, during the electrostatic test, the display device is still in a normal display mode.

An embodiment of the present application provides a display device. By setting a control unit 30 between a driving chip 20 and an electrostatic test point 11, a timing controller 40 outputs a first control signal and a second control to the control unit 30 during an electrostatic test. The control unit 30 realizes conducting or disconnecting from the driving chip 20 to form a protection circuit for the driving chip 20 under control of the first control signal and the second control signal, which can effectively prevent the driving chip 20 from damage during the electrostatic test.

Figure 2:
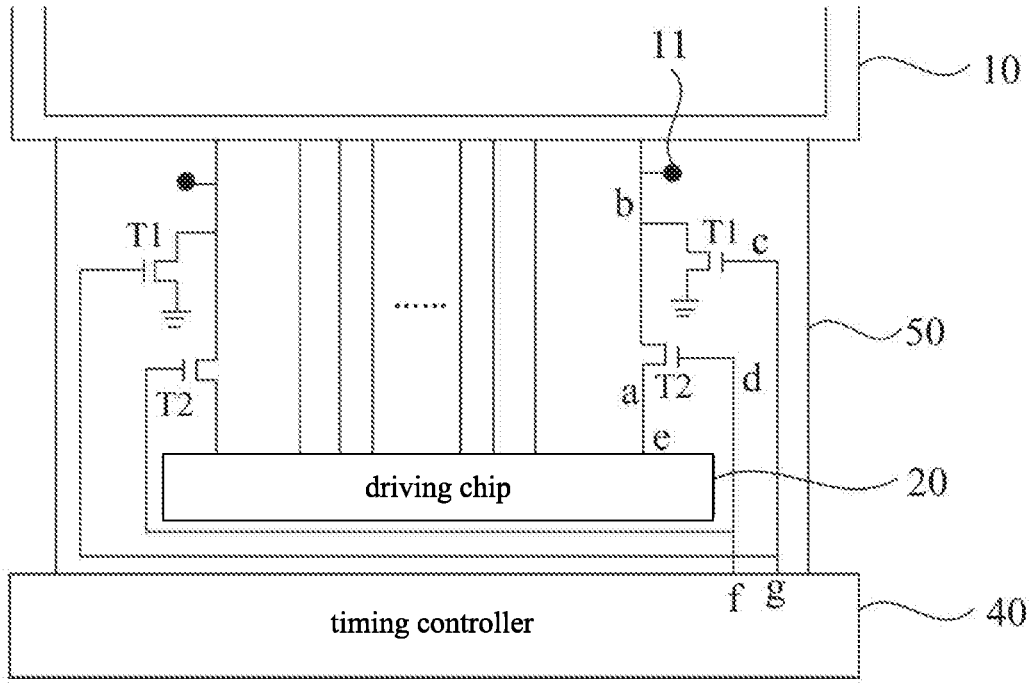
FIG. 2 is a second schematic structural diagram of the display device according to an embodiment of the present application.

Please refer to FIG. 2, in the embodiment of the present application, the control unit 30 can include a first transistor T1 and a second transistor T2. A source of the first transistor T1 is connected to an output terminal b. A gate of the first transistor T1 is connected to a first control terminal c. A drain of the first transistor T1 is grounded. A source of the second transistor T2 is connected to the source of the first transistor T1. A gate of the second transistor T2 is connected to a second control terminal d. A drain of the second transistor T2 is connected to an input terminal a. It should be noted that the drain of the first transistor T1 can be grounded by connecting a grounding line or a grounding resistance, which is not specifically limited in the present application.

Specifically, the first transistor T1 used in all the embodiments of the present application can be a thin film transistor, a field effect transistor, or other devices with same characteristics. Since the source and the drain of the first transistor T1 used here are symmetrical, the source and the drain thereof are interchangeable. In the embodiment of the present application, in order to distinguish two electrodes of the first transistor T1 except the gate, one of them is called the source, and the other is called the drain. According to the configuration in FIG. 2, a middle terminal of the first transistor T1 is the gate, a signal input terminal thereof is the drain, and an output terminal thereof is the source. In addition, the first transistor T1 used in the embodiment of the present application can be an N-type transistor or a P-type transistor, where the N-type transistor is turned on when the gate is at a high-level and is turned off when the gate is at a low-level; the P-type transistor is turned on when the gate is at a low-level, and is turned off when the gate is at a high-level. It should be noted that the configuration and working principle of the second transistor T2 in FIG. 2 are consistent with the first transistor T1, and details are not described herein again.

In the embodiment of the present application, the first transistor T1 and the second transistor T2 are same type of transistor. The first transistor T1 and the second transistor T2 of the same type are formed between a signal output terminal e of the driving chip 20 and the substrate 10, which simplifies the process and can effectively save the production capacity. However, the embodiments of the present application cannot be understood as limiting the present application.

In the embodiments of the present application, the first transistor T1 and the second transistor T2 are both N-type transistors as an example for description.

Figure 3:
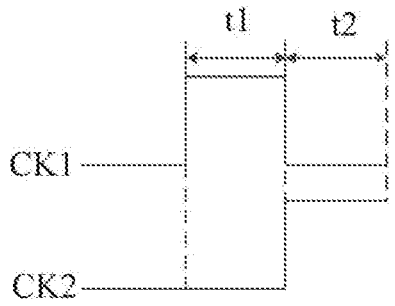
FIG. 3 is a sequence diagram of a first control signal and a second control signal according to an embodiment of the present application.

Referring to FIG. 3, when a first control signal CK1 output by the timing controller 40 is high-level and a second control signal CK2 is low-level, the display device enters a test phase t1. The first transistor T1 is turned on, and the second transistor T2 is turned off, the control unit 30 and the driving chip 20 are disconnected to form a protection circuit for the driving chip 20.

When the first control signal CK1 output by the timing controller 40 is low-level and the second control signal CK2 is high-level, the display device enters a display signal transmission phase t2. The first transistor T1 is turned off, and the second transistor T2 is turned on. At this time, a connection is formed among the control unit 30, the driving chip 20, and the substrate 10, and the driving chip 20 outputs a data signal or a scanning signal to the substrate 10 through the control unit 30 to display a screen.

When static electricity is injected within a tolerable range of the driving chip 20, the timing controller 40 can also output a low-level first control signal and a high-level second control signal to keep a connection between the control unit 30 and the driving chip 20, and conduct an electrostatic test when the display device is in a normal display mode.

It should be noted that the control unit 30 can also be consisted of other devices having same characteristics as a thin film transistor or a field effect transistor.

Furthermore, an end of the chip carrier film 50 is bound and connected to the substrate 10. It can be understood that in an actual production process, if the bonding is not good, an impedance between the substrate 10 and the driving chip 20 may be too large, causing abnormal phenomena such as micro-bright lines and bright lines on a display screen of the display device, which seriously affects display quality of the display device. Therefore, bonding effect is usually tested after the bonding process is completed. A bonding test requires at least two test points to determine whether the bonding impedance is uniform or not.

In the embodiment of the present application, a control unit 30 and an electrostatic test point 11 are respectively provided between two signal output terminals e positioned on both sides of the driving chip 20 and the substrate 10. When the control unit 30 outputs a signal to the substrate 10 under the control of the first control signal and the second control signal, the display device displays normally. At this time, the electrostatic test point 11 can be used as a panel bonding impedance test point to perform a panel bonding impedance test.

Specifically, when performing the panel bonding impedance test, an external test device can be used to connect to a bonding end through the electrostatic test point 11, an impedance difference between different bonding positions can be obtained by testing an impedance at different electrostatic test points 11, and further to determine whether the bonding impedance between the driving chip 20 and the substrate 10 is uniform or not. In an actual production process, a suitable panel bonding impedance test method can be selected according to specific conditions, which is not limited in the present application.

It should be noted that during the panel bonding impedance test, the display device can also be in an unpowered state. At this time, only the timing controller 40 needs to output the first control signal and the second control signal to the driving unit 30 to achieve a connection among the electrostatic test point 11, the substrate 10, and the driving chip 20, and the test can be performed at the electrostatic test point 11 using the external test device.

Furthermore, referring to FIG. 2, the control unit 30 includes a first transistor T1 and a second transistor T2. When the timing controller 40 outputs the first control signal and the second control signal to control the first transistor T1 to turn on and the second transistor T2 to turn off, an electrostatic test mode is entered, and the electrostatic test can be performed through the electrostatic test point 11. When the timing controller 40 outputs the first control signal and the second control signal to control the first transistor T1 to turn off and the second transistor T2 to turn on, a panel bonding impedance test mode is entered, and the panel bonding impedance test can be performed through the electrostatic test point 11.

In the embodiment of the present application, the control unit 30 is provided between the driving chip 20 and the electrostatic test point 11, and the control unit 30 is controlled by the first control signal and the second control signal output by the driving chip 40, thereby controlling a working state of the display device. While satisfying the electrostatic test, the panel bonding impedance test can also be conducted through the electrostatic test point 11, which simplifies a test circuit structure of the display device.

Figure 4:
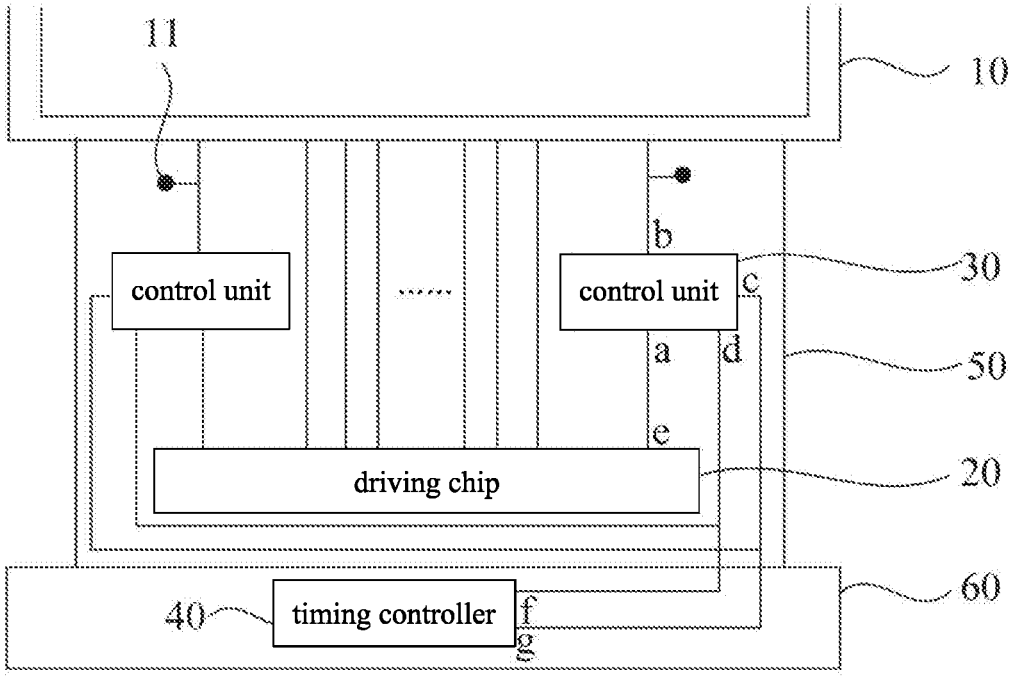
FIG. 4 is a third schematic structural diagram of the display device according to an embodiment of the present application.

Please refer to FIG. 4, in the embodiments of the present application, the display device further includes a circuit board 60. An end of the chip carrier film 50 is bound and connected to the substrate 10, and the other end of the chip carrier film 50 is bound and connected to the circuit board 60. The timing controller 40 is provided on the circuit board 60. Meanwhile, the drain of the first transistor T1 can be electrically connected to a ground terminal on the circuit board 60. The circuit board 60 can be a printed circuit board, on which a timing controller and a power chip can be provided, and the timing controller can serve as the timing controller 40. The circuit board 60 can also be a flexible circuit board, which is not limited in the present application.

The present application also provides an electronic device including the display device in the foregoing embodiments. The electronic device can be a smart phone, tablet computer, video player, personal computer (PC), etc., which is not limited in the present application.

The embodiments of the present application have been described in detail above, and specific examples have been used in the present text to explain principles and implementation of the present application. The descriptions of the above embodiments are only used to help understand the method and core idea of the present application. Those of ordinary skill in the art, based on the ideas of the present application, may have changes in specific implementations and application fields. In summary, the content of the present specification should not be construed as limiting the present application.

What is claimed is:

1. A display device, comprising:

a substrate;

a timing controller comprising a first signal output terminal and a second signal output terminal, the first signal output terminal configured to output a first control signal, and the second signal output terminal configured to output a second control signal; and a chip carrier film provided with a driving chip and a control unit, wherein the driving chip is configured to output a display signal to the substrate, the control unit comprises an input terminal, an output terminal, a first control terminal, and a second control terminal, the input terminal is connected to the driving chip, the output terminal is connected to the substrate, the first control terminal is connected to the first signal output terminal, and the second control terminal is connected to the second signal output terminal;

wherein an electrostatic test point is further provided between the output terminal of the control unit and the substrate, the control unit is configured to output the display signal to the substrate under control of the first control signal and the second control signal, and is configured to conduct an electrostatic test through the electrostatic test point.

2. The display device according to claim 1, wherein the control unit comprises a first transistor and a second transistor, wherein:

a source of the first transistor is connected to the output terminal of the control unit, a gate of the first transistor is connected to the first control terminal, and a drain of the first transistor is grounded; and a source of the second transistor is connected to the source of the first transistor, a gate of the second transistor is connected to the second control terminal, and a drain of the second transistor is connected to the input terminal of the control unit.

3. The display device according to claim 2, wherein the first transistor and the second transistor are thin film transistors of a same type.

4. The display device according to claim 3, wherein when the first transistor is turned on and the second transistor is turned off, the electrostatic test is performed through the electrostatic test point, and when the first transistor is turned off and the second transistor is turned on, the control unit outputs the display signal to the substrate.

5. The display device according to claim 1, wherein the driving chip comprises a plurality of signal output terminals, and the control unit is provided between at least one of the signal output terminals and the substrate.

6. The display device according to claim 1, further comprising a circuit board, wherein an end of the chip carrier film is connected to the substrate, and another end of the chip carrier film is secured to the circuit board, and the timing controller is disposed on the circuit board.

7. The display device according to claim 1, wherein the driving chip is a source driving chip, and the source driving chip is configured to output a data signal to the substrate.

8. The display device according to claim 1, wherein the driving chip is a gate driving chip, and the gate driving chip is configured to output a scanning signal to the substrate.

9. The display device according to claim 1, wherein when the control unit outputs the display signal to the substrate under the control of the first control signal and the second control signal, a panel bonding impedance test is performed through the electrostatic test point.

10. An electronic device comprising a display device, the display device comprising:

a substrate;

a timing controller comprising a first signal output terminal and a second signal output terminal, the first signal output terminal configured to output a first control signal, and the second signal output terminal configured to output a second control signal; and a chip carrier film provided with a driving chip and a control unit, wherein the driving chip is configured to output a display signal to the substrate, the control unit comprises an input terminal, an output terminal, a first control terminal, and a second control terminal, the input terminal is connected to the driving chip, the output terminal is connected to the substrate, the first control terminal is connected to the first signal output terminal, and the second control terminal is connected to the second signal output terminal;

wherein an electrostatic test point is further provided between the output terminal of the control unit and the substrate, the control unit is configured to output the display signal to the substrate under control of the first control signal and the second control signal, and is configured to conduct an electrostatic test through the electrostatic test point.

11. The electronic device according to claim 10, wherein the control unit comprises a first transistor and a second transistor, wherein:

a source of the first transistor is connected to the output terminal of the control unit, a gate of the first transistor is connected to the first control terminal, and a drain of the first transistor is grounded; and a source of the second transistor is connected to the source of the first transistor, a gate of the second transistor is connected to the second control terminal, and a drain of the second transistor is connected to the input terminal of the control unit.

12. The electronic device according to claim 11, wherein the first transistor and the second transistor are thin film transistors of a same type.

13. The electronic device according to claim 12, wherein when the first transistor is turned on and the second transistor is turned off, the electrostatic test is performed through the electrostatic test point, and when the first transistor is turned off and the second transistor is turned on, the control unit outputs the display signal to the substrate.

14. The electronic device according to claim 10, wherein the driving chip comprises a plurality of signal output terminals, and the control unit is provided between at least one of the signal output terminals and the substrate.

15. The electronic device according to claim 10, further comprising a circuit board, wherein an end of the chip carrier film is connected to the substrate, and another end of the chip carrier film is secured to the circuit board, and the timing controller is disposed on the circuit board.

16. The electronic device according to claim 10, wherein the driving chip is a source driving chip, and the source driving chip is configured to output a data signal to the substrate.

17. The electronic device according to claim 10, wherein the driving chip is a gate driving chip, and the gate driving chip is configured to output a scanning signal to the substrate.

18. The electronic device according to claim 10, wherein when the control unit outputs the display signal to the substrate under the control of the first control signal and the second control signal, a panel bonding impedance test is performed through the electrostatic test point.

* * * * *